US008397706B2

(12) United States Patent
Wood

(10) Patent No.: US 8,397,706 B2
(45) **Date of Patent: *Mar. 19, 2013**

(54) PAINTBALL MARKER WITH ABILITY TO DISCHARGE DIFFERENT SIZED PROJECTILES

(75) Inventor: Jack Kingsley Wood, Chesire (GB)

(73) Assignee: Plantet Eclipse Limited, Manchester (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/182,135

(22) Filed: Jul. 13, 2011

(65) Prior Publication Data

US 2011/0265777 A1 Nov. 3, 2011

Related U.S. Application Data

(63) Continuation of application No. 12/815,452, filed on Jun. 15, 2010, now Pat. No. 7,980,238.

(60) Provisional application No. 61/222,137, filed on Jul. 1, 2009.

(51) Int. Cl.
*F41B 11/00* (2006.01)

(52) U.S. Cl. ..... 124/84; 124/73

(58) Field of Classification Search ..... 124/49, 124/71–77, 83, 84

See application file for complete search history.

(56) References Cited

U.S. PATENT DOCUMENTS 1,179,021 A * 4/1916 Mayer ..... 102/446
1,809,533 A * 6/1931 Schoonover ..... 42/59
2,003,290 A * 6/1935 Gurney et al. ..... 42/105
2,898,693 A * 8/1959 Ruger ..... 42/77
3,124,889 A * 3/1964 Hellstrom ..... 42/59
3,640,013 A * 2/1972 Franklin ..... 42/77
3,742,638 A * 7/1973 Archer ..... 42/25
4,232,468 A * 11/1980 Chapin ..... 42/77
4,437,249 A * 3/1984 Brown et al. ..... 42/51
4,494,332 A * 1/1985 Matievich ..... 42/77
4,644,930 A * 2/1987 Mainhardt ..... 124/58
4,819,609 A * 4/1989 Tippmann ..... 124/72
4,867,039 A * 9/1989 Dobbins ..... 89/127
4,989,359 A * 2/1991 Kinkner et al. ..... 42/77
5,228,427 A * 7/1993 Gardner, Jr. ..... 124/71
5,363,769 A * 11/1994 Bellak et al. ..... 102/446
5,771,875 A * 6/1998 Sullivan ..... 124/72
5,845,629 A * 12/1998 Ratliff ..... 124/56
5,885,671 A * 3/1999 Bayless et al. ..... 428/34.1
6,135,005 A * 10/2000 Dobbins ..... 89/1.41
6,273,080 B1 * 8/2001 Sullivan, Jr. ..... 124/84
6,415,701 B1 * 7/2002 Dobbins ..... 89/1.41
6,494,195 B2 * 12/2002 Perry et al. ..... 124/84
6,668,815 B1 * 12/2003 Fernandez ..... 124/83
6,698,128 B2 * 3/2004 Kessler ..... 42/76.01
6,823,857 B2 * 11/2004 Perry et al. ..... 124/84
7,076,905 B2 * 7/2006 Zouboulakis ..... 42/76.01
7,243,645 B1 * 7/2007 Hatcher ..... 124/49
7,631,453 B2 * 12/2009 Longueira ..... 42/16

(Continued)

*Primary Examiner* — Michael David

(74) *Attorney, Agent, or Firm* — Barlow, Josephs & Holmes, Ltd.

(57) ABSTRACT

A paintball marker for firing a projectile includes a main body. The main body includes a breech and a feed port connected and a feed tube connected thereto. The main body is originally configured for launching a projectile having a first size. The invention includes a conversion kit to enable a marker to launch projectiles that are smaller than what can be originally launched. A breech insert is positioned within the breech, a feed insert is positioned within the feed port and a replacement barrel, with a smaller diameter bore, are provided to reduce the size of the all conduits within the marker for launching a projectile having a second size that smaller than the first size. The feed insert directly engages the breech adapter to prevent the movement of the breech adapter. Also, connection of the barrel secures the breech insert in place.

10 Claims, 6 Drawing Sheets

U.S. PATENT DOCUMENTS

| | | | | |
|---|---|---|---|---|
| 7,658,186 | B2 | 2/2010 | Yeh | |
| 7,691,759 | B2 * | 4/2010 | Perry et al. | 442/77 |
| 7,980,238 | B2 | 7/2011 | Wood | |
| 2002/0179074 | A1 * | 12/2002 | Sullivan, Jr. | 124/56 |
| 2003/0041849 | A1 * | 3/2003 | Perry et al. | 124/84 |
| 2004/0000301 | A1 * | 1/2004 | Dziob | 124/71 |
| 2004/0112356 | A1 * | 6/2004 | Hatcher | 124/41.1 |
| 2004/0237952 | A1 * | 12/2004 | Maeda et al. | 124/56 |
| 2005/0066953 | A1 * | 3/2005 | Zouboulakis | 124/73 |
| 2005/0091901 | A1 | 5/2005 | Perry et al. | |
| 2006/0011188 | A1 | 1/2006 | Jones | |
| 2006/0162217 | A1 * | 7/2006 | Longueira | 42/16 |
| 2008/0168973 | A1 * | 7/2008 | Levin et al. | 124/73 |
| 2009/0133681 | A1 | 5/2009 | Yeh | |
| 2010/0307042 | A1 * | 12/2010 | Jarboe et al. | 42/6 |

* cited by examiner

PAINTBALL MARKER WITH ABILITY TO DISCHARGE DIFFERENT SIZED PROJECTILES

CROSS REFERENCE TO RELATED APPLICATION

This application is a continuation of Ser. No. 12/815,452, filed on Jun. 15, 2010, which is related to and claims priority from earlier filed, U.S. Provisional Patent Application No. 61/222,137 filed Jul. 1, 2009, all of which is incorporated herein by reference.

BACKGROUND OF THE INVENTION

The present invention relates generally to an improved construction for a paintball marker. More specifically, the present invention relates to an improved paintball marker that can accommodate projectiles, such as paintballs, that are of differing sizes.

In the sport of paintball, pneumatically operated guns are employed to launch paint capsules or paintballs at a participant's opponent. In this regard, in order to operate, such pneumatically operated paintball guns require the use of a reliable source of compressed air or other gas. Such a supply of compressed gas is generally provided in the form of a portable gas cylinder that is mounted to the gun. In this arrangement, a large volume of highly pressurized compressed gas is stored in the gas cylinder, wherein relatively small amounts of the gas are metered out at a reduced pressure in order to operate the marker and launch the projectiles. To achieve this metering operation, the use of pressure regulators in paintball markers has become commonplace, so that the desired output pressure from the gas storage cylinder can be controlled.

Paintball projectiles are typically fed through the breech of a paintball marker in preparation for communication with a bolt to ready it for launch. The breech and feed area of the marker are design specifically for the size of the paintball that is to be received to ensure smooth operation while avoiding undesirable jamming and breakage of paintball projectiles. Since the breech and feed sections are sized to the anticipated incoming paintballs from a hopper, receipt and launching of paintballs other than the expected size are not possible. Therefore, when a paintball marker is manufactured, it is designed to discharge projectiles of a specific size because the barrel, breech and feed section of the marker are of a fixed size and dimension. For example, common sizes of projectiles fired by current paintball markers are .68 caliber and .50 caliber, which generally refer to the diameter length of the projectile in inches. The decimal point at the beginning is usually not spoken. For example, a .50 caliber projectile is usually referred to as a "fifty caliber" projectile. In a marker, the breech, feed tube, bolt and barrels are sized accordingly. Also "caliber" is typically shortened to "cal" when written, which will be referenced as such herein. Markers are designed to fire either of these specific sizes. Thus, known prior art markers can only launch projectiles of a single size thereby limiting their range of function.

There is a need in the prior art for a given paintball marker to be able to launch paintballs of different sizes. This gives the marker flexibility in use. This is useful because the characteristics and nature of a paintball can change dramatically when the size changes. For example, there is a desire for a paintball marker to launch a new size of paintball that is .50 cal in size, which is less expensive than a .68 cal paintball. As a result, the cost savings can be passed onto the paintball game player. Thus, the costs of playing paintball can be significantly reduced for more enjoyable and extended game play.

To accommodate new paintballs of different sizes, such as new smaller .50 cal paintballs, the paintball marker itself must be capable of accommodating such projectiles. Therefore, a player must have multiple markers to respectively accommodate the size of paintball that they are playing with on a given day. This not only requires a player to carry multiple markers but also bear the expense of multiple full markers. This problem occurs because current markers are fixed to launch a projectile of a given size and are incapable of being altered quick and easily to accept and discharge projectiles outside of the range that they were originally manufactured. For example, a .68 cal marker cannot fire .50 cal projectiles, and vice versa.

In view of the foregoing, there is a need for a paintball marker to be able to accommodate different sized projectiles with minimal changes to the overall construction of the marker thereby saved cost and burden on the user game player of the marker.

BRIEF SUMMARY OF THE INVENTION

The present invention preserves the advantages of prior art pneumatic powered guns or paintball markers. In addition, it provides new advantages not found in currently available pneumatic powered guns or paintball markers and overcomes many disadvantages of such currently available pneumatic powered guns or paintball markers.

The paintball marker of the present invention includes a new and novel construction to accommodate different sized projectiles, namely a new conversion kit to permit an existing paintball marker to launch smaller projectiles. The paintball marker configured for firing a projectile includes a main body that including a construction for launching a projectile. The main body includes the typical components, such as springs, air chambers, triggers and the like that are not dependent in their construction on the size of the projectiles to be launched. However, the marker includes components that are dependent on the size of the projectile, such as the barrel, the breech, the bolt, feed tube and feed port. As a result, the components, such as the barrel, the breech, the bolt, feed tube and feed port, can be modified to suit the size of the paintball to be launched while leaving the main body of the paintball marker the same. Thus, the core of the marker can still be used while only changing the above-noted components are specific to projectile size.

The main body of the mark is configured for launching a projectile having a first size, such as .68 cal. In accordance with the present invention, a unique conversion kit is provided where a number of the components are replaced with components that can accommodate and launch a smaller projectile. The components are particularly configured so that they can be retrofitted into an existing marker main body with an existing firing mechanism.

More specifically, the present invention provides a breech insert and a feed insert to reduce the size or diameter of the breech and feed port, respectively of the main body of the marker to a smaller caliber for accommodation of projectiles with a size smaller than originally intended for the paintball marker.

The marker includes a breech and a feed port with a feed tube connected thereto. The marker, namely the core main body, is originally configured for launching a projectile having a first predetermined size, such as .68 cal. The invention further includes a breech insert positioned within the breech and a feed insert positioned within the feed port to reduce the size of the bore therein to accommodate and launch a projectile having a second, smaller size, such as .50 cal.

The feed insert directly engages the breech insert to prevent the movement of the breech insert. Such interconnection rotationally and longitudinally keys the breech insert within the breech of the marker main body. The breech adapter is retained within the marker by routing the feed insert through the feed port. The breech insert defines a projectile port for receiving a bottom portion of said feed insert to prevent movement of the breech insert. To provide additional stability, a feed tube is releasably attached to the main body of the marker about the feed port. The construction of the feed tube is specifically constructed to help secure the feed insert within the feed port and in communication with the breech insert. The barrel is replaced with a second barrel that has a bore for accommodating and launching projectiles of the second, smaller size, such as .50 cal.

In operation, the breech insert and feed insert are installed to reduce the size of the breech and the feed port to permit launching of the projectile having a second smaller size. For example, the marker may have a breech, feed port, and feed tube configured for a .68 cal (i.e. "sixty eight caliber") projectile. Installation of the breech insert and feed insert enables a smaller, such as a .50 cal (i.e. "fifty caliber") projectile, to be launched from the marker using the same main body and firing mechanism and other internal components.

Thus, a conversion kit is provided that reduces the size of the breech and feed port to accommodate a different array of projectile and sizes. The conversion kit is provided with at least a feed insert and a breech insert, which when positioned within the marker, will permit the launching of a projectile having a second smaller size. The conversion kit further includes a second replacement barrel configured for launching a projectile having the second smaller size, a feed tube, a second replacement bolt mechanism configured for launching the projectile having the second smaller size, a set of longer detents configured for launching the projectile having the second smaller size, and the tools necessary to complete the conversion of a paintball marker.

An object of the present invention is to provide a conversion kit for a paintball marker to accommodate different sized projectiles.

Another object of the present invention is to provide a paintball marker having a breech insert, feed insert, replacement barrel, replacement bolt and replacement detents to step down all projectile conduits in the marker to a smaller size to accommodate and launch smaller projectiles while using the same paintball marker main body and firing mechanism therein.

BRIEF DESCRIPTION OF THE DRAWINGS

The novel features which are characteristic of the closure are set forth in the appended claims. However, the closure, together with further embodiments and attendant advantages, will be best understood by reference to the following detailed description taken in connection with the accompanying drawing Figures.

DETAILED DESCRIPTION OF THE PREFERRED EMBODIMENTS

Figure 1:
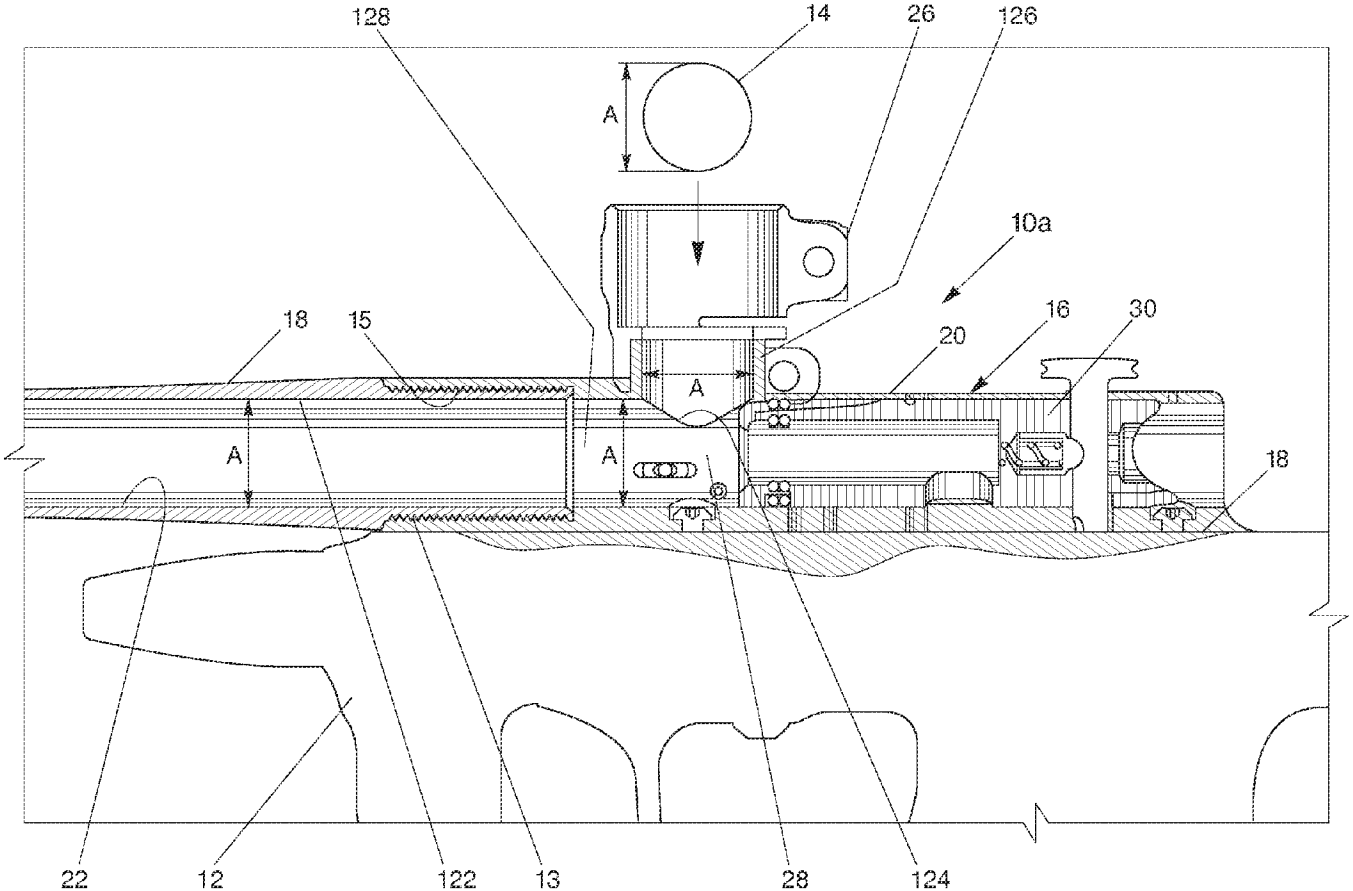
Fig. 1 (Prior Art)
FIG. 1 is a cross-sectional view of a prior art .68 cal paintball marker.

Referring to the first to FIG. 1, a prior art paintball marker 10*a* is shown to include a main body 12, which incorporates a variety of components known in the art for launching a projectile 14, such as various gas chambers, triggers, springs and the like. These components are so well known in the art, they need not be discussed further herein.

Still referring to FIG. 1, the main body 12 of the paintball marker 10*a* includes a trigger mechanism (not shown) for activating a series of solenoid valves (not shown) that release gas from a gas supply (not shown), at the appropriate time, into a pneumatic launching assembly (not shown) which facilitates the launching of the projectile through a top portion 16 of the main body 12 of the marker 10*a*. The gas supply may include external compressed gas sources, such as carbon dioxide, nitrogen, or compressed air. It should be noted the trigger mechanism may consist of other types of actuation means other than solenoid valves. Triggering of the release of gas in such pneumatic launching assemblies is so well known that they need not be discussed in further detail herein. Examples of suitable paintball markers are available commercially from Planet Eclipse located at www.planeteclipse.com and incorporated herein by reference. These components are well known and need not be discussed in further detail herein.

A barrel 18 is located at the front portion of the main body 12. For example, the barrel 18 is preferably threadably connected via threads 13 into female threaded bore 15 in the housing 20 or formed integrally with a rear housing 20. The barrel 18 includes a bore 22, which guides the projectile 14 out a front end of the barrel 18. A feed port 24 is connected to a feed tube 26 through which the projectile 14 is loaded into breech 28. The feed tube 26 is disposed above the breech 28 for connecting with a hopper (not shown) to supply the projectile 14 at a predetermined time. The projectile 14 is loaded into the barrel 18 for launching the projectile 14 after activation of the solenoid valves or springs (not shown), as is very well known in the art. In addition, the main body 12 includes a reciprocating bolt 30 positioned within the breech 28 and housing 20.

It should be understood that the top portion 16 of the main body 12 is configured and dimensioned to accommodate the commonplace .68 cal projectiles, as is generally indicated by the dimension lines "A" in the barrel 18, breech 28 and feed tube 26. The components of the barrel 18, breech 28, feed tube 26 and bolt 30 are specially dimensioned to accommodate .68 cal projectiles 14.

Figure 2:
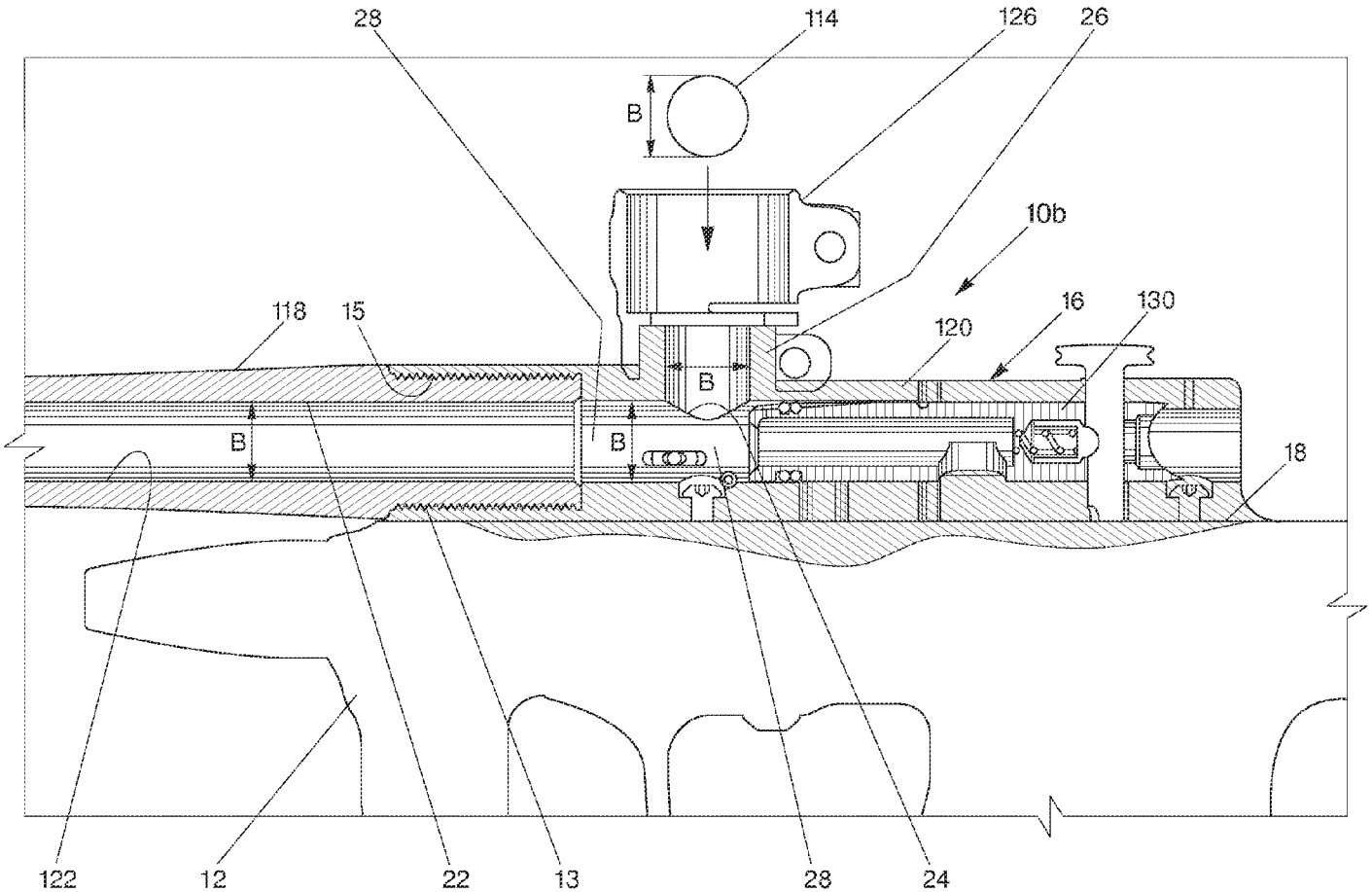
Fig. 2 (Prior Art)
FIG. 2 is a cross-sectional view of a prior art .50 cal paintball marker.

Turning now to FIG. 2, a second prior art marker 10*b*, with main body 12 is shown. This second prior art configuration is the same as the configuration in FIG. 1, however, all of the components of the marker 10*b* are dimensioned to be smaller than marker 10*a* to accommodate the smaller .50 cal projectile, as indicated by arrows B. In this case, a smaller bolt 130 and appropriately sized feed tube 126 are provided. A smaller bore 122 in provided in .50 cal barrel 118.

It should be noted that it is possible that the top portion 16 of the main body of the markers 10*a* or 10*b* may be a separate component that can be easily detached. Different detachable portions 16 that are dimensioned differently may be provided. For example, one top portion 16 may be dimensioned for accommodating projectiles that are .68 cal while another may be dimensioned to accommodate projectiles that are of the smaller .50 cal. The top portions 16 may be interchangeable by the user so they may easily modify the marker to accommodate different sized projectiles. In this case, the majority of the main body 12 of the marker 10 can still be used, such as the trigger assembly and primary pneumatics (not shown).

The preferred embodiment 100 of the present invention is shown in FIGS. 3-6. In this embodiment, a "conversion kit" is provided to enable a .68 cal marker, such as marker 10*a* in FIG. 1, to be converted over to a marker, similar to the marker 10*b*, shown in FIG. 2, that can accommodate smaller .50 cal projectiles.

The marker 100 includes a main body 216 with a barrel 118 threadably connected thereto via threads 113 that communicate with female treaded bore 115 in the main body 216, namely the rear housing 120. A breech insert 218, with flanges 218*a* and a projectile port 218*b* installed therein. With the barrel 118 threadably removed, the breech insert 218 is routed into seat 216*a* defined by housing 216 to form a new smaller dimensioned breech 128 for accommodating and launching smaller projectiles, such as those that are .50 cal in size. An appropriately sized bolt 130 is also located with the breech insert 218. When a new (replacement) barrel, that is sized to accommodate .50 cal projectiles, is threaded onto the housing 216, the flanges 218*a* of the breech insert 218 are captured against seat 216*b* to laterally secure the breech insert 218.

A feed insert 220 is routed through boss 126 of feed port 124 to step down the size of the feed port to a smaller size, such as to a dimension suitable for accommodating a .50 cal projectile. The feed insert 220 is tubular with an angled lower end 220*a* that engages with projectile port 218*b* of the breech insert 218. Further details of this construction can be seen in FIGS. 5 and 6. Most notably, the bottom surface 220*a* of feed insert 220 has a configuration, such as a V-shape that is complementary with the projectile port 218*b*, which, in this case is a U-shape. This interconnection prevents the breech insert 218 from moving laterally and rotationally within the breech 216*a*, as indicated by the arrows in FIG. 5. Apertures 221 are also provided to receive the appropriately sized (longer) detents (not shown) to communicate with the smaller .50 projectiles. Such detents are installed from outside the main body 12 of the marker 10 in the normal course. For example, eye covers (not shown) are removed to access this detent apertures 221.

Figure 4B:
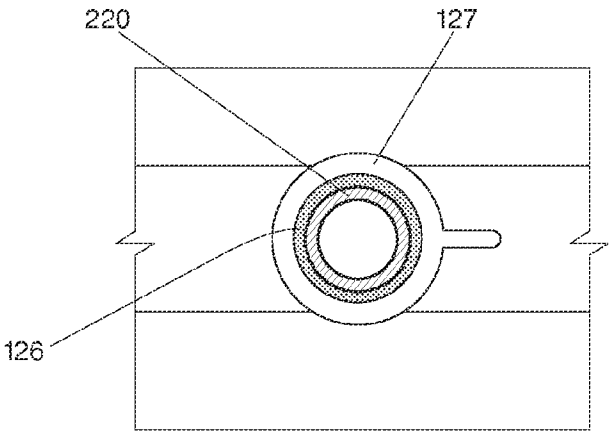
FIG. 4B is a cross-sectional view through the line 4B-4B of FIG. 3.
Figure 4A:
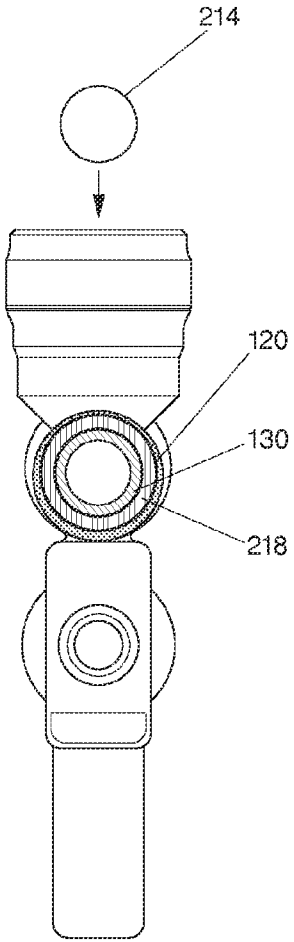
FIG. 4A is cross-sectional view through the line 4A-4A of FIG. 3.
Figure 5:
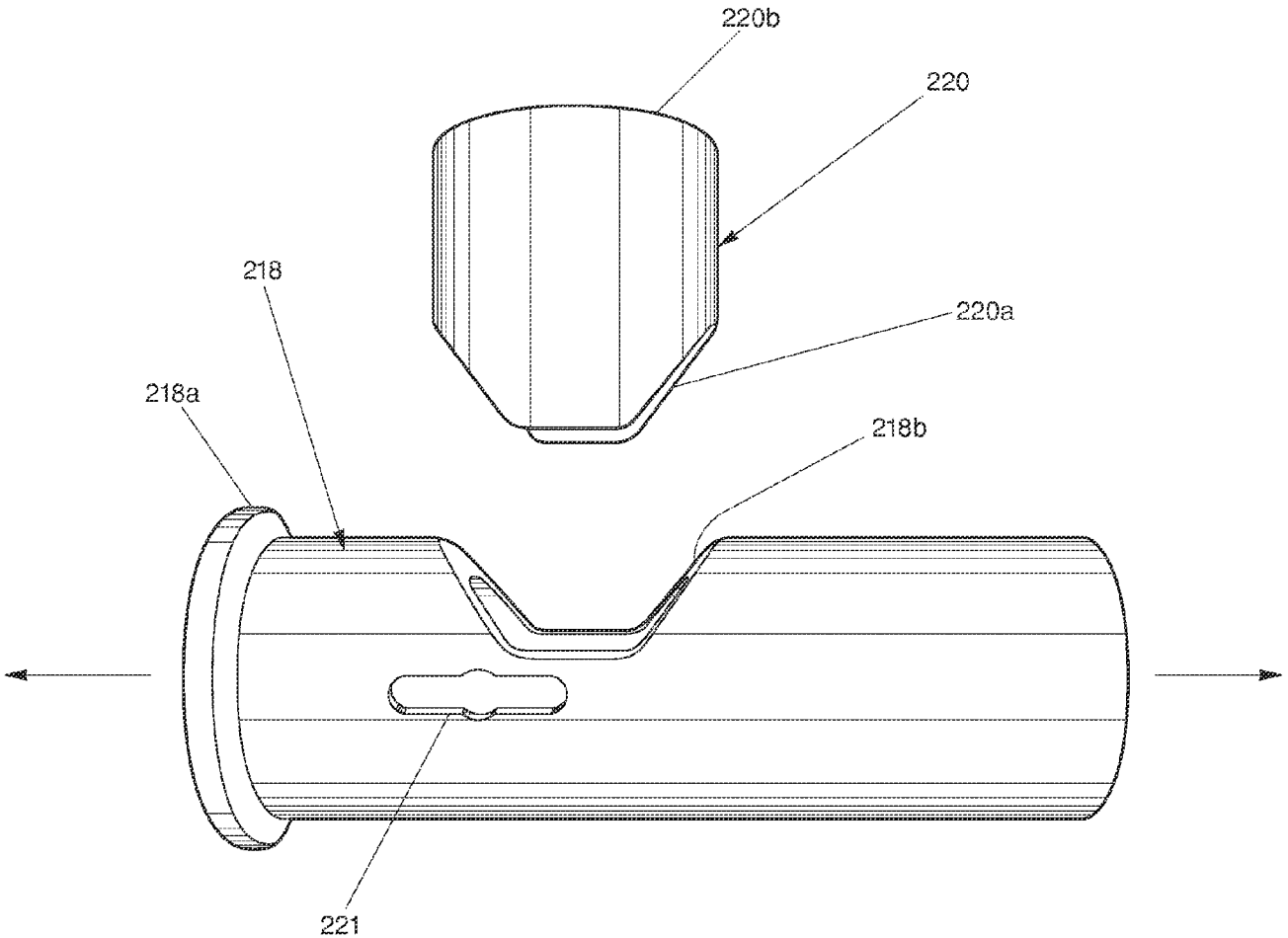
FIG. 5 is a front elevational view showing the interconnection of the feed insert into the breech insert.
Figure 6:
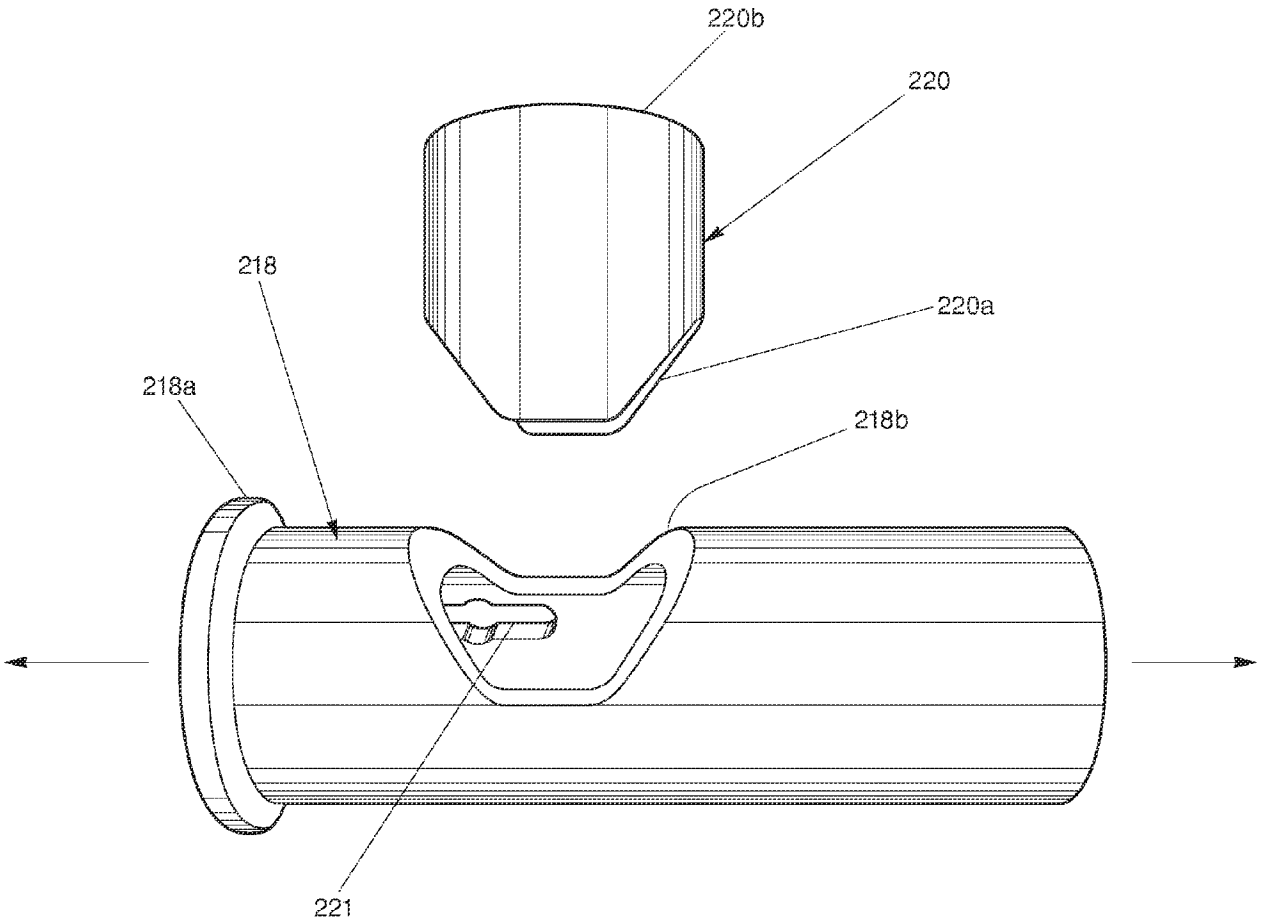
FIG. 6 is a front perspective view showing the interconnection of the feed insert into the breech insert.

Referring to FIGS. 4A and 4B further details of the use of the breech insert 218 and feed insert 220 is shown. FIG. 4A further illustrates the use of breech insert 218. The breech insert 218 steps down the size of the breech from .68 cal to .50 cal, for example. It should be noted that the present invention may modify any marker 10 of any size and then step it down to accommodate a smaller sized projectile.

Referring back to FIG. 3, the barrel 118 includes a bore 122, which guides the projectile 214 out a front end of the barrel 118. The boss 126 feed port 124 is connected to a feed tube 127, such as by a clamping mechanism for example (not shown), with a feed tube insert 220 installed therein through which the projectile 214 is loaded into new smaller breech 128. Feed insert 220 steps down the size of the feed tube from .68 cal to .50 cal. FIG. 4B further illustrates the use of feed insert 220. The feed tube 127 includes a flange 127*a*, or some other type of structure, to vertically bear downwardly on the top edge 220*b* of the feed insert 220. Thus, the feed tube 127, when locked in place, helps to secure the feed insert 220 in place, which, in turn, locks the breech insert 218 in place.

The feed port 124, formed by the inner bore of feed insert 220 are disposed above the projectile port 218*b*. The feed tube 127 is configured for connection to a hopper (not shown) to supply projectiles 214 at the desired time. The projectile 214 is loaded through the projectile port 218*b* and into the (stepped down) breech 128 for launching the projectile 214 after the usual activation of the solenoid valves or springs (not shown), as is very well known in the art. The usual launching is carried out using reciprocating bolt 130, which is also sized for the smaller .50 cal projectiles, which is positioned within the breech insert 128, which resides within housing 120.

Figure 3:
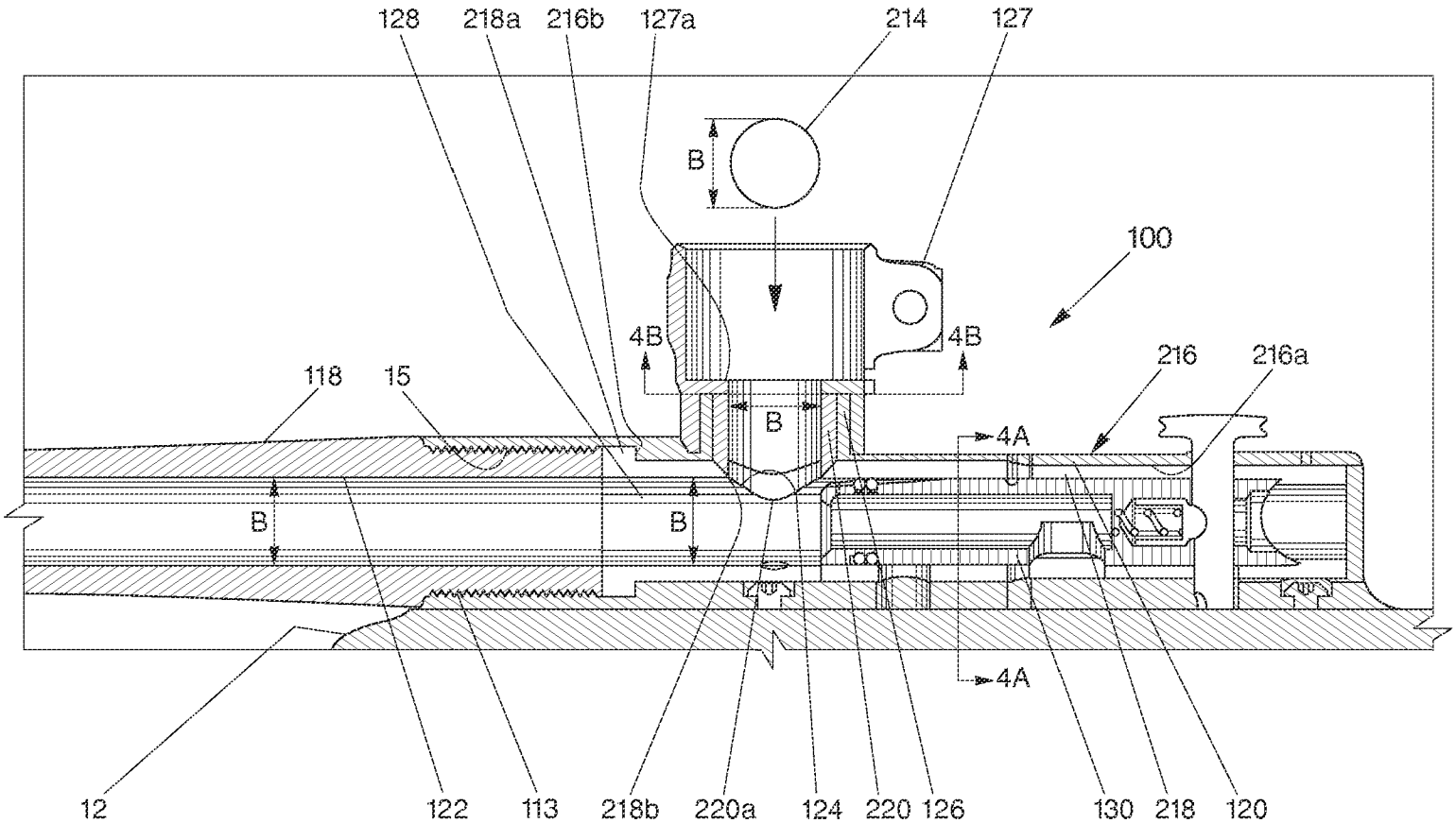
FIG. 3 is cross-sectional view of the .68 cal paintball marker of FIG. 2 with a .50 cal conversion kit of the present invention installed.

It should be understood that the main body 216 of FIG. 3 is now configured and dimensioned to accommodate smaller projectiles, such as .50 cal projectiles, as is generally indicated by the dimension lines "B" in the barrel 118, breech 128 and breech insert 218. The components of the barrel 118, breech insert 218, feed insert 220 and bolt 130 are specially dimensioned to accommodate .50 cal projectiles 214.

Still referring to FIGS. 3, 4A and 4B, the marker 100 may be constructed so that it is relatively easy to remove, replace, or install new components for the marker construction rather than using an entirely different dedicated marker for a different sized projectile. The present invention obviates the need for such a separate marker and avoids the costs associated therewith. In general, the present invention provides a feed insert 220 and a breech insert 218 for correspondingly reducing a size or diameter of the breech 28 and feed port 24 of the main body 216 (of a .68 cal marker of FIG. 1) to a smaller caliber for accommodation of a projectile 214 with such a smaller caliber.

The breech 28 and feed port 24 of a marker, as seen in FIG. 1, can be modified where components can be inserted in or removed from the breech 28 and feed port 24 of the marker 10 to step it down to simulate an entirely different marker 10*b*, as seen in FIG. 2, which launches smaller projectiles. Essentially, the internal dimensions of the marker 10 that contact projectiles 14, 114 are adapted with minimal effort to conform it for launching the projectile of the desired size. By retaining the majority of the main firing and loading components of the marker 10 within the main body 12, and 216 of FIG. 3, and having to change only the minimum possible number of components when alternating between caliber sizes, it allows a cost effective, simple and practical way of discharging differing sized projectiles from the same main body 12 and using common components thereof.

For example, the breech insert 218 and feed insert 220 are both preferably removably and frictionally fit within housing 120 and boss 126 about the feed port 124, respectively. The breech insert 218 is inserted through the open front end of housing 120 and the feed insert 220 is inserted through a top end of boss 126. The breech insert 218 and feed insert 220 ensure a proper travel path of the smaller projectile 214 during launch.

The inner diameter of the breech insert 218 and the feed insert 220 are configured to provide a breech 128 and feed port 124. The outer diameter of the breech insert 218 and feed insert 220 are sized as large as possible while still slidably engaging within the housing 120, so that inner walls of the housing 120 and boss 126 provide radial support. For example, a breech 28 of a .68 cal marker, such as seen in FIG. 1, preferably has a 18 mm inner diameter and the .50 cal breech insert 218 that slides into it preferably has a 17.9 mm outer diameter. The internal diameter of that breech insert 218 is preferably 13 mm, but the barrel 118 that screws into the body 120 and accelerates the paintball is 0.500". Barrel diameters can vary, depending on the exact size of the paint. For example, it is also possible to provide a .68 cal barrel kit that has a range of bore sizes from 0.685" up to 0.693". It should be understood that these dimension could vary depending on the type, size and configuration of the marker.

In addition, the outer surface of the breech insert 218 and the feed insert 220 may include one or more grooves (not shown) for accepting corresponding collars, such as O-rings, to provide small amount of friction to help slightly retain the breech insert 218 or feed insert 220 in place.

While metal material are preferred, such as machines aluminum, the breech insert 218 and feed insert 220 may use materials other than metal and may attach within the housing 120 of the housing 120 of the marker 100 by a variety of methods, which are able to withstand repetitive forces of launching the projectile 214. The thickness of the wall of the breech insert 218 and the feed insert 220 are selected according to the outer diameter of the housing 120 and boss 126 and feed port 124, respectively, to provide the desired inner diameter to accommodate projectile 14.

Still referring to FIGS. 3, 4A and 4B, the feed insert 220 and breech insert 218 may be sold as separate components, or as part of a conversion kit (not shown). A conversion kit may be utilized to reduce the size of the breech 28 to that seen as 128 in FIG. 3. In can be understood that, as above, the conversion kit can further include a conversion barrel 218 configured for launching a projectile having the second stepped-down size to substantially match the inner diameters of the breech insert 218 and feed insert 220. In fact, an entire set of multiple adapters can be provided to step down the size of the top body so it can accommodate different sized projectiles.

The paintball marker 100 of the present invention may be constructed of materials with sufficient strength and durability to provide repetitive and reliable performance. For example, the main body 16, 116, 216 may be constructed of machined aluminum, extruded plastic or other materials known in the art. The projectile 14, 114, 214 which is preferably spherical in form, may be a paintball. However, the projectiles used in the present invention are not limited to paintballs of various dimensions and sizes, but may also include shooting capsules, marking pellets, ball bearings, rubber rounds, BBs, and other types of projectiles which can be fired pneumatically as well as mechanically. Also, the present invention is not limited to paintball markers 10 but may also be used in other pneumatically powered projectile assemblies.

In view of the foregoing, a .68 cal marker can be modified to accommodate the smaller .50 cal projectiles by using adapter inserts at various locations within the marker 100. A .50 cal barrel 218; a .68 cal housing 120 with a breech insert 218 installed therein; and a .68 cal boss 126 and feed port 124 with and feed insert 220 installed therein, are used to carry out this configuration.

It would be appreciated by those skilled in the art that various changes and modifications can be made to the illustrated embodiments without departing from the spirit of the embodiments. All such modifications and changes are intended to be covered by the appended claims.

What is claimed is:

1. An apparatus for launching projectiles, comprising:

a main body including a means for launching projectiles; the main body including a breech and a feed port both being configured for accommodating and launching projectiles of a first size;

a breech insert, having a front end and a back end and side wall with a projectile port passing therethrough, residing in the breech to accommodate and launch projectiles of a second size; the second size being smaller than the first size; the feed port and the projectile port being substantially aligned with each other;

whereby the apparatus is configured to launch projectiles of the first size when the breech insert is not residing in the breech and whereby the apparatus is configured to launch projectiles of the second size when the breech insert is residing in the breech.

2. The apparatus of claim 1, further comprising:

a first bolt and a first barrel for launching projectiles of the first size; the first bolt being installed in the main body and the first barrel being connected to the main body;

a second bolt and a second barrel for launching projectiles of the second size; the second bolt being interchangeably installed in the main body with the first bolt and the second barrel being interchangeably connected to the main body with the first barrel.

3. The apparatus of claim 2, wherein connection of the second barrel to the main body secures the breech insert within the breech.

4. The apparatus of claim 3, wherein the projectile port of the breech insert is substantially U-shaped.

5. The apparatus of claim 1, wherein the first size projectile is .68 cal and the second size projectile is .50 cal.

6. A method for converting a projectile launching apparatus to accommodate and launch projectiles of a smaller size, comprising the steps of:

providing a paintball marker having a main body, a first bolt, a first barrel having an inner diameter, a feed tube, a feed port and breech configured for launching a projectile having a first size; the first bolt residing in the main body and the first barrel being connected to the main body;

removing the feed tube from the paintball marker;

removing the first barrel from the paintball marker;

removing the first bolt from the main body;

providing a breech insert having a front end and a back end;

inserting a breech insert, having a projectile port, through a front end of a bore in the main body to reside in the breech; the projectile port being substantially aligned with the feed port; and attaching the feed tube to the main body about the feed port.

7. The method of claim 6, further comprising the steps of:

providing a second barrel having an inner diameter less than the inner diameter of the first barrel;

connecting the second barrel to the main body to accommodate and launch projectiles of a second size and to secure the breech insert within the breech.

8. The method of claim 7, further comprising the steps of:

providing a flange connected to the front end of the breech insert; the main body defining a seat for receiving the flange of the breech insert; and connecting the second barrel to the main body to secure the breech insert in place within the main body.

9. The method of claim 7, wherein the second barrel is threadably connected to the main body.

10. The method of claim 6, wherein the first size is .68 cal and the second size is .50 cal.

* * * * *